US011325010B2

(12) United States Patent
Hutt

(10) Patent No.: US 11,325,010 B2
(45) Date of Patent: May 10, 2022

(54) SYSTEM AND METHOD FOR PLAYING A PIN BASED GAME USING AN IMPACT RESISTANT BALL AND PROCESS OF FORMING THE SAME

(71) Applicant: FOWLING ENTERPRISES, LLC, Hamtramck, MI (US)

(72) Inventor: Christopher Hutt, Hamtramck, MI (US)

(73) Assignee: FOWLING ENTERPRISES, LLC, Hamtramck, MI (US)

( * ) Notice: Subject to any disclaimer, the term of this patent is extended or adjusted under 35 U.S.C. 154(b) by 0 days.

(21) Appl. No.: 17/104,250

(22) Filed: Nov. 25, 2020

(65) Prior Publication Data

US 2021/0077862 A1 Mar. 18, 2021

Related U.S. Application Data

(63) Continuation-in-part of application No. 16/325,864, filed as application No. PCT/US2017/047137 on Aug. 16, 2017, now abandoned.

(Continued)

(51) Int. Cl.
*A63B 43/00* (2006.01)
*A63B 41/08* (2006.01)

(Continued)

(52) U.S. Cl.
CPC ..... *A63B 43/002* (2013.01); *A63B 41/02* (2013.01); *A63B 41/085* (2013.01); *A63B 43/06* (2013.01);

(Continued)

(58) Field of Classification Search
CPC ..... A63B 43/002; A63B 41/085; A63B 63/00; A63B 41/02; A63B 43/06; A63B 2225/50;

(Continued)

(56) References Cited

U.S. PATENT DOCUMENTS 533,102 A * 1/1895 Thomson ..... F41J 1/10 273/407
2,874,965 A * 2/1959 Martin ..... A63B 41/08 473/597

(Continued)

FOREIGN PATENT DOCUMENTS

BR 8802581 U2 * 3/2010
CN 210021116 U * 2/2020

(Continued)

OTHER PUBLICATIONS

Wikipedia, "Football (ball)", <https://en.wikipedia.org/wiki/FootballL(ball>, retrieved on Sep. 2, 2021 (Year: 2021).*

(Continued)

*Primary Examiner* — Steven B Wong
(74) *Attorney, Agent, or Firm* — Blue Filament Law PLLC

(57) ABSTRACT

A system and method for playing a pin based game with an impact resistant ball and process of forming an impact resistant ball are provided. The impact resistant ball has an increased resistance to damage caused to a ball by repeated impact with objects such as a game board and game pins thereby decreasing the frequency with which the ball must be replaced. The impact resistant ball also has utility to afford a larger segment of the population the ability to properly grip and throw the impact resistant ball by providing an increased length gripper able to accommodate a greater range of hand sizes. The impact resistant ball has further utility to automatically identify and transmit data including the impact of the ball with the game pins and ball metrics including speed, pressure and weight.

20 Claims, 4 Drawing Sheets

Related U.S. Application Data

(60) Provisional application No. 62/376,042, filed on Aug. 17, 2016.

(51) Int. Cl.
*A63B 63/00* (2006.01)
*A63B 41/02* (2006.01)
*A63B 43/06* (2006.01)

(52) U.S. Cl.
CPC ..... *A63B 63/00* (2013.01); *A63B 2220/30* (2013.01); *A63B 2220/52* (2013.01); *A63B 2220/53* (2013.01); *A63B 2220/56* (2013.01); *A63B 2220/833* (2013.01); *A63B 2225/50* (2013.01); *A63B 2225/76* (2020.08)

(58) Field of Classification Search
CPC ..... A63B 2220/53; A63B 2225/76; A63B 2220/52; A63B 2220/833; A63B 2220/30
See application file for complete search history.

(56) References Cited

U.S. PATENT DOCUMENTS 2,923,548 A * 2/1960 Kappel ..... A63F 9/0278 273/386
3,039,771 A * 6/1962 Bablouzian ..... A63B 71/0009 473/56
3,117,783 A * 1/1964 Reid ..... A63F 7/3065 473/470
3,463,490 A * 8/1969 Domenico ..... A63D 3/00 473/116
3,708,170 A 6/1973 Presnell
3,887,183 A * 6/1975 Saso ..... A63D 9/00 473/76
3,975,014 A * 8/1976 Ryan ..... A63D 5/08 473/80
4,150,823 A * 4/1979 Boganowski ..... A63B 67/04 273/317.5
4,330,130 A * 5/1982 Carr ..... A63F 9/0204 206/315.1
4,337,944 A 7/1982 Massino
4,462,590 A * 7/1984 Mitchell ..... A63B 41/08 273/DIG. 8
4,660,831 A * 4/1987 Kralik ..... A63B 41/00 473/603
4,869,504 A * 9/1989 Kralik ..... A63B 41/08 473/597
5,098,097 A * 3/1992 Kennedy ..... A63B 41/00 473/599
5,421,585 A * 6/1995 Ruvio ..... A63B 67/06 273/350
5,577,724 A 11/1996 Gandolfo
5,975,982 A * 11/1999 Spector ..... A63H 33/18 446/175
D426,541 S 6/2000 Morgan
6,241,251 B1 * 6/2001 Trifonov ..... A63B 67/06 273/339
D550,314 S * 9/2007 Lauderdale ..... D21/712
8,317,641 B1 * 11/2012 Lowinger ..... A63B 43/02 473/597
8,900,076 B1 * 12/2014 Shropshire ..... A63B 63/008 473/439
9,289,657 B1 3/2016 Rice
9,968,832 B1 * 5/2018 Lo ..... A63B 41/085
2002/0103047 A1 * 8/2002 Ou ..... A63B 41/08 473/603
2003/0069097 A1 * 4/2003 Guenther ..... A63B 41/08 473/599
2006/0199684 A1 * 9/2006 Kelly ..... A63B 43/008 473/599
2006/0293132 A1 12/2006 Laliberty et al.
2008/0188334 A1 * 8/2008 Feeney ..... A63B 41/08 473/605
2010/0009768 A1 * 1/2010 Munson, Jr. ..... A63F 7/0023 473/1
2011/0118064 A1 5/2011 Krysiak et al.
2012/0021857 A1 1/2012 Raymond
2014/0024483 A1 1/2014 Bevier
2014/0080643 A1 3/2014 Lin
2014/0194232 A1 * 7/2014 Krysiak ..... G09B 19/0038 473/570
2014/0274504 A1 9/2014 Hu et al.
2016/0214000 A1 * 7/2016 Mruk ..... A63D 5/04
2018/0264336 A1 * 9/2018 Florentino ..... A63B 71/0036
2019/0184241 A1 * 6/2019 Hut ..... A63B 41/02
2020/0047060 A1 * 2/2020 Bauer ..... A63F 7/0668

FOREIGN PATENT DOCUMENTS

DE 2918193 A1 11/1980
ES 1075579 U * 11/2011

OTHER PUBLICATIONS

International Search Report dated Nov. 28, 2017 for International Application No. PCT/US2017/047137 filed Aug. 16, 2017.
https://fowlingwarehouse.com/?gclid=Cj0KCQiA-bjyBRCcARIsAFboWg1Sdf2tiYg5le6bv1jCWimqQdrQc8_7JBRGikeYO1g-abE_LlvZptkaAji1EALw_wcB.
U.S. Appl. No. 16/325,864, filed Feb. 15, 2019.

* cited by examiner

SYSTEM AND METHOD FOR PLAYING A PIN BASED GAME USING AN IMPACT RESISTANT BALL AND PROCESS OF FORMING THE SAME

CROSS-REFERENCE TO RELATED APPLICATIONS

This application is a continuation-in-part of U.S. application Ser. No. 16/325,864 filed 15 Feb. 2019 that in turn is a U.S. National Phase of PCT Application Serial Number PCT/US2017/047137 filed 16 Aug. 2017 that in turn claims priority of U.S. Provisional Application Ser. No. 62/376,042 filed 17 Aug. 2016; the contents of which are hereby incorporated herein by reference.

FIELD OF THE INVENTION

The present invention in general relates to a system and method for playing a pin based game using an impact resistant ball and a process of forming the same; and in particular to a system and method for playing a pin based game using an impact resistant ball having an inflatable bladder contained within a shell, a gripper, and a skin contacting an outer surface of the shell.

BACKGROUND OF THE INVENTION

Games involving the setting up, striking, and knocking down of individual game pins set up on a playing surface or a game board often require an object such as a ball to effectuate the striking and knocking down of individual game pins. Typically, with this type of game, a player throws or otherwise sets in motion an object such as ball towards the individual game pins. Depending on the rules of the specific game being played, the general goal is usually to strike or knock down the individual game pins with an object such as a ball. A single game can be made up of several rounds. For example, a single game may include 10 rounds, where each player gets 2 or more throws per round. A player's progress can then be scored in a variety of ways. For example, a player could be rewarded a predetermined amount of points for the number of pins knocked down per throw or in a competitive timed fashion.

Individual game pins are often set up on a game board. The game board can be constructed from a variety of materials illustratively including plywood, plastic, concrete or metal. Such materials are not very forgiving on an object such as a ball upon impact of the ball with the game board. A natural incident to games requiring the throwing of a ball towards individual game pins is the inevitable repeated impact of the ball with the game board and the individual game pins as well as other objects surrounding the playing area. Such repeated impact causes nicks and other damage to the ball. The game board often contains sharp edges and corners, posing an even greater risk to the integrity of a ball upon impact. Sometimes, in the case of a ball with an inflatable bladder, the damage sustained from a single impact could be complete penetration of the ball's outer surface as well as the inflatable bladder contained within the ball. The risk of impact related damage presents challenges which become exacerbated when playing a game made of up several rounds, where a ball may be thrown between 50 and 100 times per game.

One challenge in particular is the cost of replacing damaged balls. A challenge that becomes more amplified when playing a game made up of several rounds, and even more amplified when the game uses a ball that must be purchased for a non-nominal cost such as an American football. If the game is intended to be played in a private setting such as a backyard or the beach, a one-time purchase of the game board and pins, along with the purchase of one game ball may be all that is required to begin playing the game. However, if the damage sustained to the ball incident to playing the game is so severe that the ball must be frequently replaced, the replacement cost may be prohibitive. For example, in a game such as FOWLING™ which currently uses American footballs, the average life expectancy of one American football is less than one week. An American football has an inflatable bladder surrounded by a skin which is laced together to form the football. This construct lacks additional support and impact-resistance under the skin and as a result, an American football has a finite elasticity leaving it susceptible to nicks and other damage including penetration of the skin and puncture of the bladder after repeated impacts with other objects including a game board. If the game is intended to be played in a public setting such as a for-profit facility, then the owner of the facility usually provides the game board, game pins and balls. In this scenario, if the damage sustained the ball incident to playing the game is so severe that the ball must be frequently replaced, the replacement cost may be so prohibitive that it cuts into the profits of running such a facility or even worse, drives up the operating costs to a point where the business is no longer profitable at all.

Another challenge stemming from the need to replace a ball subject to repeated impact and frequently damaged, is repeated game stoppage in order to obtain a new ball. Such repeated game stoppage could negatively impact the pace, and ultimately the overall enjoyment of the game. This inefficiency becomes even more acute in the context of league play or multiple games being playing back-to-back which increases the frequency with which game balls are damaged and replaced.

A further challenge stemming from using a game ball such as an American football is the size of the gripper made up of the laces used to sew the ball together. A regulation sized American football can be hard for a large segment of the population to grip and properly throw owing to the relatively small size of the gripper compared with the overall size of the ball. Women, children, young adults and even some adult males have trouble securely gripping the gripper which leads to difficulty in properly throwing the American football in a manner that achieves a spiral rotation of the ball. As such, a game that requires the throwing of an American football marginalizes a large segment of the population who otherwise might enjoy playing the game if the ball was more amenable to a greater range of hand sizes. This negatively affects the appeal, marketability and ultimate success of such a game.

Current balls used in the industry to address the pitfalls stemming from using a ball frequently damaged after repeated impacts with other objects such as a game board and game pins are not satisfactory in that they do not provide a ball with increased impact resistance under the skin nor do they provide a ball with an increased length gripper able to accommodate a greater range of hand sizes.

Thus, for games that require the throwing of a ball towards game pins set up on a game board having sharp edges and corners with the goal of striking and knocking down the game pins with the ball, there exists a need for an impact resistant ball with an increased resistance to damage sustained from repeated impacts with objects such as the game board and game pins. There further exists a need for an impact resistant ball with an increased length gripper able to be properly gripped and thrown in a spiral rotation by a larger segment of the population including those with smaller hand sizes such as women, children, the elderly and young adults. There also exists a need for a process of forming an impact resistant ball with an increased length gripper

SUMMARY OF THE INVENTION

A system for playing a pin based game is provided and includes an elevated game board adapted to receive a plurality of game pins, the elevated game board having at least one of sharp edges, sharp corners, and a surface, and an impact resistant ball having a shell with an outer surface in the shape of a prolate spheroid, the shell defining an interior volume formed of two or more complimentary plastic or elastomer components joined together having a plurality of apertures. An inflatable bladder is contained within the shell, with a skin contacting the outer surface of the shell. A gripper defined by a central spine on the outer surface of the ball has a plurality of protrusions oriented perpendicularly relative to and intersecting the central spine. The plurality of protrusions are adapted to engage one of the plurality of apertures. The shell and skin protect the inflatable bladder after at least 50 repeated substantial impacts with the elevated game board at an impact force of at least 100 times the force of gravity.

A process is provided for forming a ball, the process includes inflating a bladder contained within a shell having an outer surface, covering the outer surface of the shell with a skin, and integrating a gripper being defined by a central spine having a plurality of protrusions oriented perpendicularly relative to and intersecting the central spine.

A method is provided for playing a pin based game, the method includes situating a plurality of game pins on an elevated game board having at least one of sharp edges, sharp corners, and a surface, throwing an impact resistant ball to undergo substantial impacts with the plurality of game pins, the elevated game board, or a combination thereof, the shell and skin protecting an inflatable bladder within the ball after at least 50 repeated impacts with the plurality of game pins, the elevated game board, or a combination thereof at an impact force of at least 100 times the force of gravity, and felling at least one of the plurality of game pins with the ball.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

Figure 1:
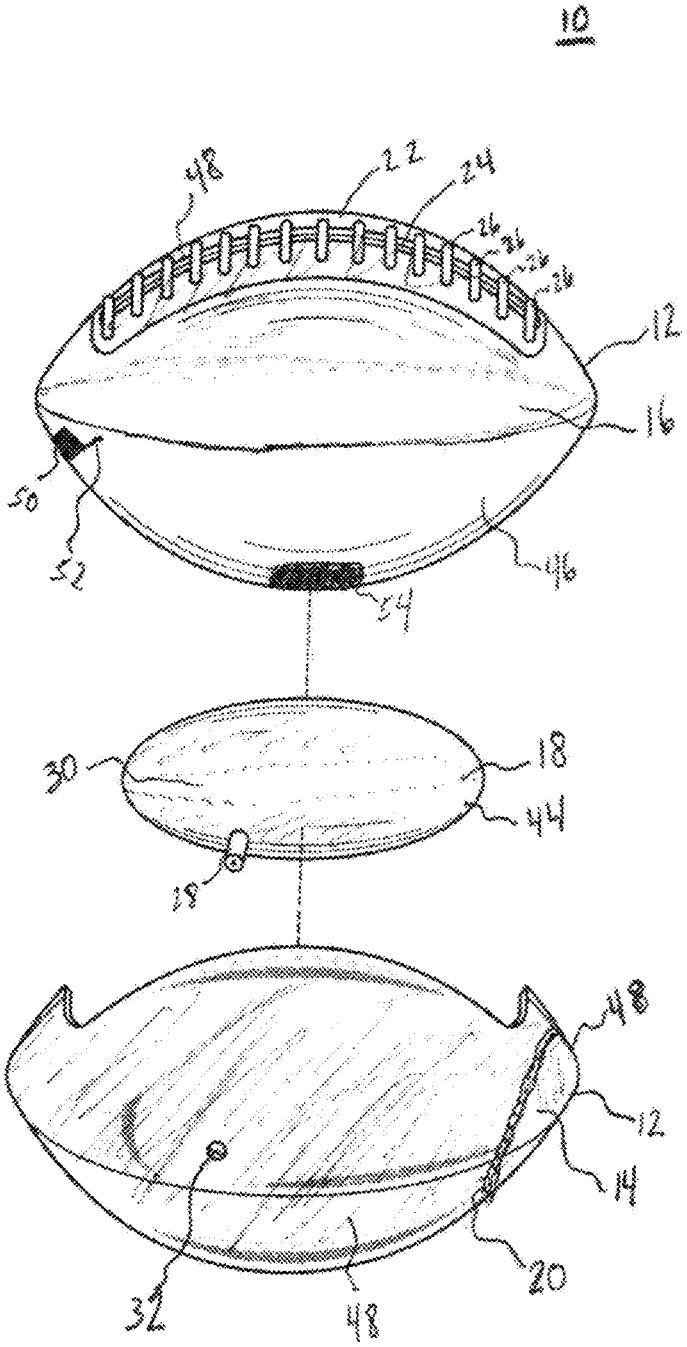
FIG. 1 is an exploded view of a ball in accordance with an embodiment of the present invention.

A system and method for playing a pin based game using an inventive impact resistant ball and process of forming an impact resistant ball are provided. The present invention has utility to increase the resistance to damage caused to a ball by repeated impact with objects such as a game board and game pins thereby decreasing the frequency with which the ball must be replaced. The present invention also has utility to afford a larger segment of the population the ability to properly grip and throw the impact resistant ball by providing an increased length gripper able to accommodate a greater range of hand sizes. In some embodiments, the present invention has further utility to automatically identify and transmit data including the impact of the ball with the game pins and ball metrics including speed, pressure and weight.

In this disclosure. "comprises." "comprising," "containing" and "having" and the like can have the meaning ascribed to them in U.S. Patent law and can mean "includes," "including," and the like. "consisting essentially of or "consists essentially" likewise has the meaning ascribed in U.S. Patent law and the term is open-ended, allowing for the presence of more than that which is recited so long as basic or novel characteristics of that which is recited is not changed by the presence of more than that which is recited but excludes prior art embodiments.

It is to be understood that in instances where a range of values are provided that the range is intended to encompass not only the end point values of the range but also intermediate values of the range as explicitly being included within the range and varying by the last significant figure in the range. By way of example, a recited range from 1 to 4 is intended to include 1-2, 1-3, 2-4, 3-4, and 1-4. By way of further example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges. "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "or" is understood to be inclusive. Unless specifically stated or obvious from context, as used herein, the terms "a," "an," and "the" are understood to be singular or plural.

Also, as used herein, "and/or" refers to and encompasses any and all possible combinations of one or more of the associated listed items, as well as the lack of combinations when interpreted in the alternative ("or").

The suffix "(s)" as used herein is intended to include both the singular and the plural of the term that it modifies, thereby including one or more of that term.

Reference throughout the specification to "one embodiment", "another embodiment", "an embodiment", and so forth, when present, means that a particular element (e.g., feature, structure, and/or characteristic) described in connection with the embodiment is included in at least one embodiment described herein, and may or may not be present in other embodiments. In addition, it is to be understood that the described elements may be combined in any suitable.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

Figure 2:
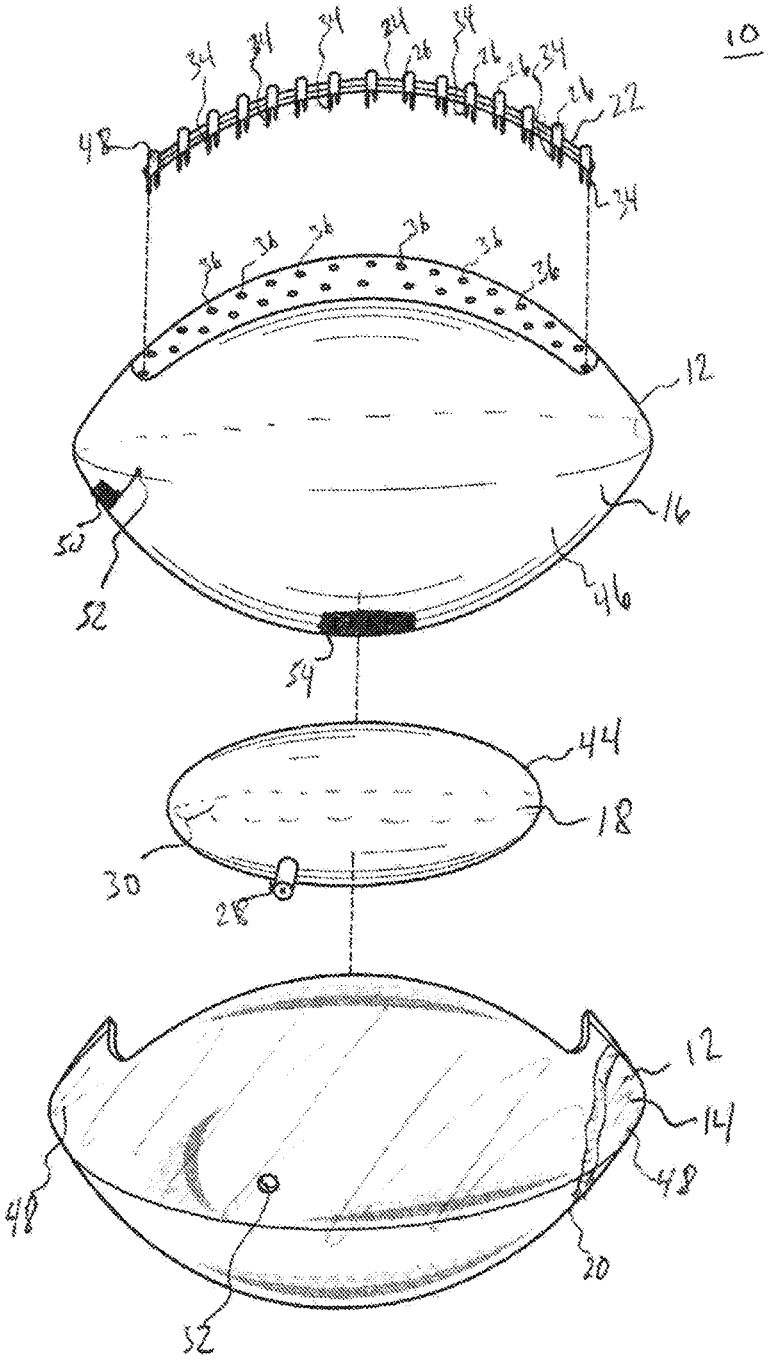
FIG. 2 is an exploded view of an impact resistant ball in accordance with an embodiment of the present invention.
Figure 4:
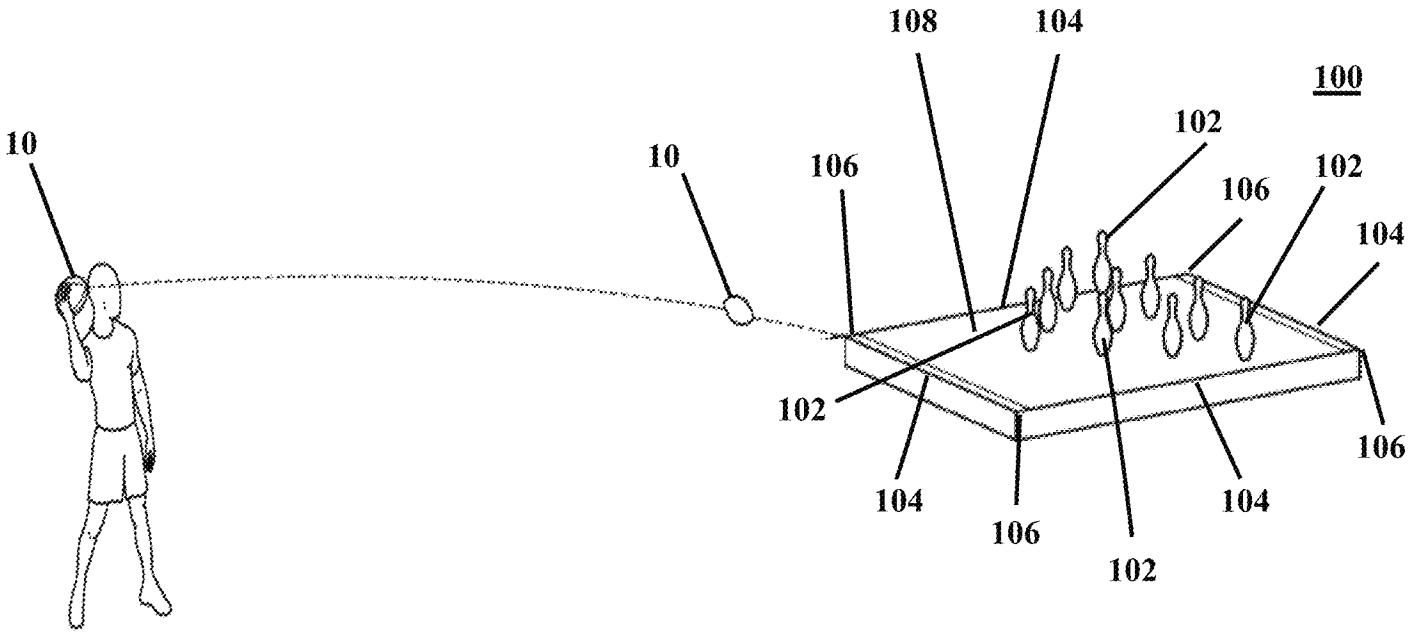
FIG. 4 is a perspective view of an impact resistant ball being thrown to undergo a substantial impact with a sharp corner of the elevated game board.

Referring now to the figures, FIG. 4 is a perspective view of an elevated game board shown generally at 100 adapted to receive a plurality of game pins 102, the elevated game board having sharp edges 104, sharp corners 106, and a surface 108. An inventive impact resistant ball 10 is being thrown in a spiral motion to undergo substantial impact with a sharp corner 106 of the elevated game board 100. It is appreciated that the inventive impact resistant ball 10 may be thrown in motions other than a spiral. FIG. 1 is an exploded view of the inventive impact resistant ball is shown generally at 10. A shell 12 having an outer surface 14 defines the shape of the impact resistant ball 10. In some inventive embodiments, the shape of the impact resistant ball 10 is a prolate spheroid. It is appreciated that the shell 12 defines an interior volume 16. An inflatable bladder 18 is contained within the shell 12. While the shell 12 is depicted as being formed of two complimentary components joined together, it is appreciated that the shell 12 may be a single unitary component or may be formed of more than two components. It is also appreciated that in some inventive embodiments, at least one of the components has a plurality of apertures 36 (as shown in FIG. 2). It is further appreciated that the shell 12 may be formed from plastic or elastomer. It is still further appreciated that the shell 12 may be reversibly compressible under an external grip pressure of between 10 kilograms and 70 kilograms. It is appreciated that the shell 12 provides an increased impact resistance to the inventive impact resistant ball 10 relative to an American football formed from only an inflatable bladder and a skin. It is further appreciated that the shell 12 provides for an increased elasticity relative to an American football owing in part to the reversible compressibility of the shell 12.

As best shown in FIG. 4, the inventive impact resistant ball 10 to be used in embodiments of the inventive system and method is designed to be thrown toward a set of game pins 102 placed on an elevated game board 100 that has sharp edges 104 and sharp corners 106. Unlike conventional footballs that are not designed to undergo repeated impacts with sharp edges and corners, the impact resistant ball 10 according to embodiments of the present invention has a reinforcing shell 12 that protects the internal inflatable bladder 18 from repeated impacts with the sharp edges 104 and corners 106 of the elevated game board 100, as well as the plurality of game pins 102. A skin 20 is in contact with the outer surface 14 of the shell 12. It is appreciated that the skin 20 adds an additional layer of impact resistance to the inventive impact resistant ball 10. It is further appreciated that unlike a conventional football which is generally designed to be caught or run with and rarely undergoes substantial impact with sharp objects, embodiments of the inventive impact resistant ball 10 are intended to be thrown at hard and sharp targets. The inventive multiple part shell 12 imparts at least two forms of protection to the resulting impact resistant ball 10: firstly, by making the skin 20 less deformable and less prone to puncture, and secondly, by protecting the inflatable bladder 18 from the localized high forces associated with impact with the game board 100, the game pins 102, other objects, or a combination thereof. A common mechanism of conventional football failure in the present context is that the skin is punctured with a line cut or "V-shaped" cut by striking a sharp game board edge 104 or corner 106, respectively. If the impact is insufficient to rupture the bladder on initial impact, the bladder herniates into the cut thereby leaving the inflated, soft rubber bladder vulnerable to follow-on impact. The present invention addresses this problem by resort to a multipart shell 12 that interacts with a gripper 22 to form an armoring to greatly extend the life of an inventive impact resistant ball 10 relative to a conventional football. It is appreciated that the inventive impact resistant ball 10 is capable of withstanding more than 50 impacts with the elevated game board 100. To illustrate these forces, it is appreciated that a professional football quarterback has been measured throwing a football at 60 miles per hour (MPH) or 96.56 kilometers per hour. Using this velocity, a maximum impact force may be calculated for an inventive impact resistant ball 10 striking a solid target that does not deform on impact (e.g. a plywood platform), while the ball has a 10% deformation. In certain inventive embodiments, the inventive impact resistant ball 10 weighs 16 ounces (0.45 kilogram) (a regulation football is between 14 and 15 ounces) and has a length of 11 inches (27.94 centimeters) tip to tip that equates to a deformation on impact of 2.79 cm, the impact force is calculated as follows:

$$F_{max}=\tfrac{1}{2}mv^2/s, \text{ where "s" is the deformation distance (m)}$$

$$F_{max}=\tfrac{1}{2}(0.45\text{ kg})(26.82\text{ m/s})^2/(0.0279\text{ m})=5800.91\text{ N.}$$

The gravitation force exerted on the ball is $F_w=m\ g=(0.45\text{ kg})\ (9.81\text{ m/s}^2)=4.4$ N. Thus, the impact of an inventive impact resistant ball 10 creates a force of 1313 times the force of gravity. Thus, even if the average person playing a pin based game of the present invention only throws the ball at 30 MPH the impact force exerted on the ball 10 is still over 600 times the force of gravity. Given the range of strength across the human population, in some inventive embodiments, the impact force exerted on the ball 10 is between 100 and 2000 times the force of gravity. In other inventive embodiments, the impact force exerted on the ball 10 is between 300 and 1700 times the force of gravity. In still other inventive embodiments, the impact force exerted on the ball 10 is between 500 and 1500 times the force of gravity.

Referring back to FIG. 1, a valve 28 in fluid communication with an interior 30 of the inflatable bladder 18 and extending outward therefrom may be provided. It is appreciated that the skin 20 may have a valve aperture 32 adapted to receive the valve 28. It is further appreciated that the skin 20 may fully cover the shell 12. It is still further appreciated that the skin 20 may cover only a part of the shell 12. It is also appreciated that the skin 20 may be formed from one or multiple layers of material including leather, synthetic leather, rubber, plastic, poly-aramid, elastomer or a combination thereof. It is appreciated that the skin 20 may simulate the tactile feel of an American football. In some inventive embodiments, the skin 20 has a thickness of between 0.5 millimeters and 5 millimeters and a tensile strength of at least 4100 psi. In one embodiment, a gripper 22 defined by a central spine 24 having a plurality of protrusions 26 oriented perpendicularly relative to the central spine 24 is attached to the skin 20 with a sonic welder, complimentary strips of VELCRO®, a contact adhesive or a combination thereof. In embodiments, the plurality of protrusions 26 are oriented perpendicularly relative to and intersecting the central spine 24. In other embodiments, each of the plurality of protrusions 26 are adapted to engage one of a plurality of apertures 36. In another embodiment, as depicted in FIG. 2, the gripper 22 further comprises a plurality of pins 34 complimentary to the plurality of apertures 36. It is appreciated that the plurality of pins 34 engage the gripper 22 to the shell 12 when received by the plurality of apertures 36. In still another embodiment, the outer surface 14 of the shell 12 further comprises the central spine 24 and the plurality of protrusions 26 which define the gripper 22. It is appreciated that in all embodiments, the plurality of protrusions 26 may be between 9 and 30 protrusions 26. Preferably between 9 and 25 protrusions 26. Most preferably between 9 and 20 protrusions 26. It is further appreciated that in all embodiments, the plurality of protrusions 26 may be simulative of laces. It is still further appreciated that the plurality of protrusions 26 is more than the amount of laces provided on standard American football which makes the impact resistant ball 10 easier to grip and properly throw by a greater range of hand sizes as the increased number of protrusions 26 allows the gripper 22 to extend along a greater length of the inventive ball 10. Accordingly, the gripper 22 is accessible not only at the center of the inventive ball 10 where the ball diameter is greatest, but also near the ends of the inventive ball 10 where the diameter of the inventive ball 10 is smaller. This allows players to access the gripper 22 with their fingertips at nearly any position along the length of the inventive ball 10, which is particularly helpful for players with smaller hands who may only be able to sufficiently wrap their hand around the circumference of the inventive ball 10 near the ends of the inventive ball 10. Thus, the present invention provides an impact resistant ball 10 that is suitable for players of all ages and hand sizes, thereby providing a single standard ball and eliminating the need to manufacture, purchase, provide, store, and replace balls of numerous different sizes. In some embodiments, a sensor 50 having a wireless transceiver 52 is affixed to the inventive impact resistant ball 10. It is appreciated that the sensor 50 is capable of detecting an impact of the impact resistant ball 10 with another object, a speed of the impact resistant ball 10, an internal pressure of the impact resistant ball 10, a weight of the impact resistant ball 10, a leak in the inflatable bladder 18, a tear in the skin 20 or a combination thereof. It is further appreciated that the sensor 50 is capable of communicating with an external logic board (not pictured) via the wireless transceiver 52. It is still further appreciated that the data generated by the sensor 50 may be used to generate automatic scoring of a game being played with the inventive impact resistant ball 10 when the data is communicated to an external logic board (not pictured) via the wireless transceiver 52. It is appreciated that the sensor 50 may be a photometer or a pressure sensor. A weighted member 54 may be used to adjust the weighting of the inventive impact resistant ball 10. In some specific inventive embodiments, the weighted member 54 is used to adjust the weight of the inventive impact resistant ball 10 to between 0.34 kilograms and 0.48 kilograms. In other specific inventive embodiments, the weighted member 54 is used to adjust the weight of the inventive impact resistant ball 10 to between 0.37 kilograms and 0.45 kilograms. In still other specific inventive embodiments, the weighted member 54 is used to adjust the weight of the inventive impact resistant ball 10 to between 0.40 kilograms and 0.43 kilograms. It is appreciated that the weighted member 54 may be used to achieve a weighting that simulates the weight of an American football. A coating of phosphorescent paint 48 may be applied to the outer surface 14 of the shell 12, the skin 20, the gripper 22 or a combination thereof. It is appreciated that the coating of phosphorescent paint 48 allows to inventive impact resistant ball 10 to be used in a game being played in low-light conditions. It is further appreciated that the coating of phosphorescent paint 48 also makes the inventive impact resistant ball 10 easier to locate after a throw when the impact resistant ball 10 is being used in a game being played in low-light conditions.

FIG. 2 is an exploded view of the inventive impact resistant ball 10 according to one embodiment, where like reference numerals have the meanings ascribed thereto in the aforementioned drawing. The impact resistant ball 10 depicted in FIG. 2 depicts the gripper 22 having a plurality of pins 34 complimentary to a plurality of apertures 36 according to one embodiment of the invention. It is appreciated that the plurality of pins 34 engage the gripper 22 to the shell 12 when received by the plurality of apertures 36.

Figure 3A:
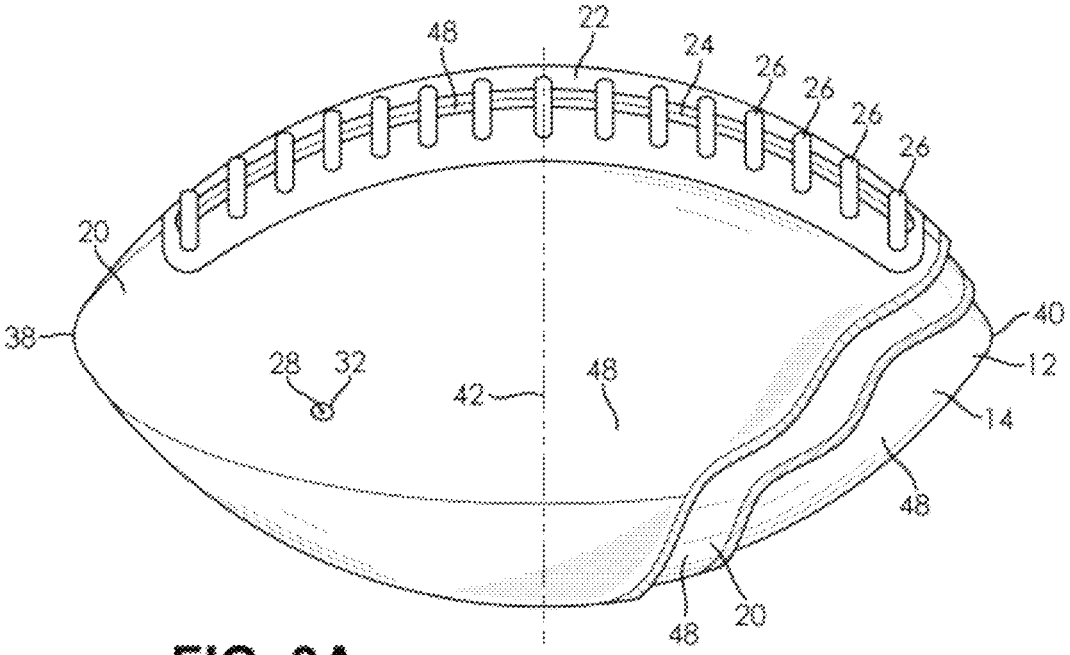
FIG. 3A is a perspective view of an impact resistant ball in accordance with an embodiment of the present invention.

FIG. 3A is a perspective view of the inventive impact resistant ball 10 according to one embodiment, where like reference numerals have the meanings ascribed thereto in the aforementioned drawings. In some embodiments, the shell 12 is a prolate spheroid having a first pole 38, a second pole 40 and an equatorial diameter 42. It is appreciated that the distance between the first pole 38 and the second pole 40 is longer than the equatorial diameter 42. In inventive embodiments, the length of an inventive impact resistant ball 10 is between 20 and 35 centimeters from tip to tip. In other inventive embodiments, the length of an inventive impact resistant ball 10 is between 25.4 and 30.5 centimeters tip to tip. In specific inventive embodiments, the gripper 22 is centrally oriented between a central 40% and a central 80% of the outer surface 14 of the shell 12 relative to the distance between the first pole 38 and the second pole 40. In other specific inventive embodiments, the gripper 22 is centrally oriented between a central 50% and a central 70% of the outer surface 14 of the shell 12 relative to the distance between the first pole 38 and the second pole 40. In still other specific inventive embodiments, the gripper 22 is centrally oriented between a central 55% and a central 65% of the outer surface 14 of the shell 12 relative to the distance between the first pole 38 and the second pole 40. In all inventive embodiments, it is appreciated that the plurality of protrusions extends parallel to the equatorial diameter 42.

Figure 3B:
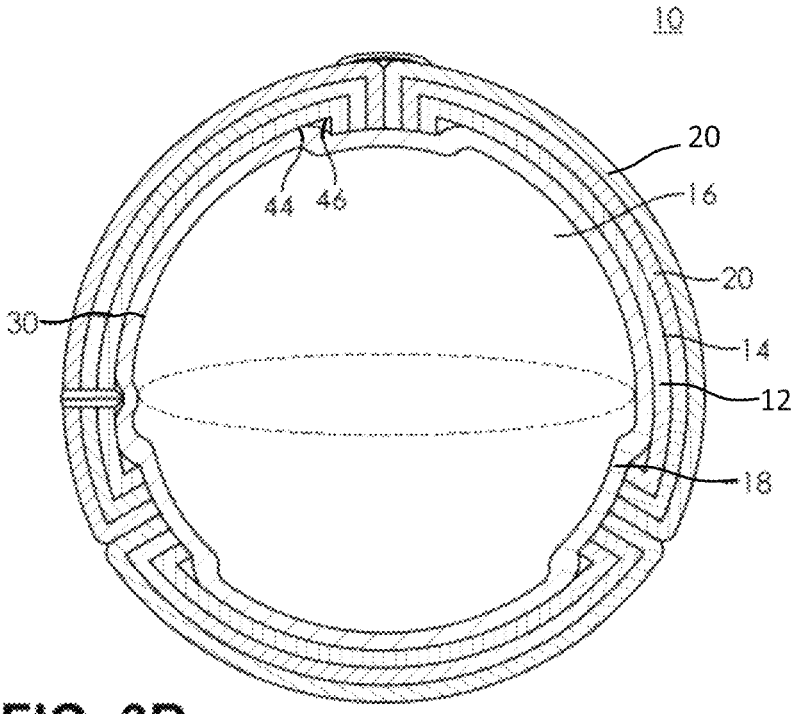
FIG. 3B is a partial cutaway front view of an impact resistant ball in accordance with an embodiment of the present invention.

FIG. 3B is a cutaway front view of the inventive impact resistant ball 10 according to one embodiment. The inflatable bladder 18 may be filled with a liquid, a gas or a combination thereof. It is appreciated that the inflatable bladder 18 may be filled until an exterior 44 of the inflatable bladder 18 contacts an inner surface 46 of the shell 12. In some specific inventive embodiments, the inflatable bladder

18 is inflated to an internal pressure of between 11 psi and 15 psi. In other specific inventive embodiments, the inflatable bladder 18 is inflated to an internal pressure of between 12 psi and 14 psi. In still other specific inventive embodiments, the inflatable bladder 18 is inflated to an internal pressure of between 12.5 psi and 13.5 psi. It is appreciated that inflation of the inflatable bladder 18 allows for fined-tuned control of the bounce of the inventive impact resistant ball 10. It is further appreciated that attenuation of the internal pressure of the inflatable bladder 18 allows for fine-tuned control of the flexibility of the shell 12. The internal pressure of the inflatable bladder 18 fluctuates over time and after repeated uses of the inventive impact resistant ball 10 and that such fluctuation, without an avenue to recalibrate the internal pressure, may decrease the impact resistance of the inventive impact resistant ball 10. As such, it is appreciated that attenuation of the internal pressure of the inflatable bladder 18 affords a degree of control over the relative impact resistance of the inventive impact resistant ball 10 allowing for recalibration of the internal pressure and continued maximization of the relative impact resistance over time and after repeated uses of the inventive impact resistant ball 10. An inflatable bladder 18 is readily formed of conventional vulcanized elastomers. In some embodiments, the bladder 18 is sheathed with strips of protective material such as those from which the skin 20 are formed to inhibit impact puncture of herniated bladder through a damaged skin 20.

An inventive process for forming an inventive impact resistant ball 10 is also provided and includes inflating a bladder 18 contained within a shell 12 having an outer surface 14, covering the outer surface 14 of the shell 12 with a skin 20, and integrating a gripper 22 being defined by a central spine 24 having a plurality of protrusions 26 of between 9 and 30 protrusions oriented perpendicularly relative to and intersecting the central spine 24. In inventive embodiments, the process also includes inflating the bladder 18 to an internal pressure of between 11 psi and 15 psi. In other inventive embodiments, the process also includes adjusting a weighting of an inventive impact resistant ball 10 with at least one weighted member. In some inventive embodiments, the weighting of the impact resistant ball is between 0.34 kilograms and 0.48 kilograms.

An inventive method for playing a pin based game using an inventive impact resistant ball 10 is also provided and includes situating a plurality of game pins 102 on an elevated game board 100 having at least one of sharp edges 104, sharp corners 106, and a surface 108, throwing an inventive impact resistant ball 10 to undergo substantial impacts with the plurality of game pins 102, the elevated game board 100, or a combination thereof, the shell 12 and the skin 20 protecting the inflatable bladder 18 after at least 50 repeated impacts with the plurality of game pins 102, the elevated game board 100, or a combination thereof, and felling at least one of the plurality of game pins 102 with the impact resistant ball 10. In some inventive embodiments, the method also includes generating an impact force of between 500 and 1500 times the force of gravity exerted on the impact resistant ball 10 upon substantial impact with the plurality of game pins 102, the elevated game board 100, or a combination thereof.

As a person skilled in the art will recognize from the previous detailed description and from the figures and claims, modifications and changes can be made to the preferred embodiments of the invention without departing from the scope of this invention defined in the following claims.

The invention claimed is:

1. A system for playing a pin based game comprising:

a plurality of game pins;

an elevated game board adapted to receive the plurality of game pins thereon in an upright position, the elevated game board having a surface and at least one of sharp edges or sharp corners formed thereon; and an impact resistant ball comprising a shell having an outer surface in the shape of a prolate spheroid, said shell defining an interior volume formed of two or more complementary plastic or elastomer components joined together having a plurality of apertures;

an inflatable bladder contained within said shell;

a skin contacting the outer surface of said shell; and a gripper defined by a central spine having a plurality of protrusions of between 9 and 30 protrusions oriented perpendicularly relative to and intersecting the central spine, said plurality of protrusions adapted to each engage one of said plurality of apertures, said shell and skin protecting said inflatable bladder after at least 50 repeated impacts with the elevated game board at an impact force of at least 100 times the force of gravity, wherein the ball is thrown to undergo substantial impacts with the elevated game board and the plurality of game pins.

2. The system of claim 1 further comprising a valve in fluid communication with an interior of said inflatable bladder and extending outward therefrom.

3. The system of claim 2 wherein said skin further comprises a valve aperture adapted to receive said valve.

4. The system of claim 1 wherein said gripper further comprises a plurality of pins complimentary to the plurality of apertures in said shell, the plurality of pins engaging said gripper to said shell when received by the plurality of apertures.

5. The system of claim 1 wherein the outer surface of said shell further comprises the central spine and the plurality of protrusions defining said gripper.

6. The system of claim 1 wherein the plurality of protrusions is simulative of laces.

7. The system of claim 1 wherein said gripper is centrally oriented between a central 55 percent and a central 80 percent of the outer surface of said shell relative to the distance between a first pole and a second pole and wherein the plurality of protrusions extend parallel to the equatorial diameter.

8. The system of claim 1 wherein said skin has a thickness of between 0.5 millimeters and 5 millimeters and a tensile strength of at least 4100 psi.

9. The system of claim 1 further comprising a coating of phosphorescent paint applied to the outer surface of said shell, said skin, said gripper or a combination thereof.

10. The system of claim 1 wherein said ball further comprises a sensor having a wireless transceiver, said sensor detecting an impact of said ball with another object, a speed of said ball, an internal pressure of said ball, a weight of said ball, a leak in said inflatable bladder, a tear in said skin, or a combination thereof, wherein said sensor communicates with an external logic board via the wireless transceiver.

11. The system of claim 1 wherein the surface is plywood.

12. The system of claim 1 wherein the ball weighs between 0.40 and 0.45 kilograms and has a length of between 25.4 and 30.5 centimeters tip to tip.

13. The system of claim 12 wherein the ball weighs 0.45 kilograms, has a length of 27.94 centimeters, and has a deformation of 2.79 centimeters on substantial impact with the plurality of game pins, the elevated game board, or a combination thereof.

14. The system of claim 1 wherein the impact force is between 500 and 1500 times the force of gravity.

15. A process for forming a ball of claim 1 comprising:

inflating a bladder contained within a shell having an outer surface;

covering the outer surface of said shell with a skin; and integrating a gripper being defined by a central spine having a plurality of protrusions of between 9 and 30 protrusions oriented perpendicularly relative to and intersecting the central spine.

16. The process of claim 15 further comprising inflating said inflatable bladder to an internal pressure, wherein said internal pressure is between 11 psi and 15 psi.

17. The process of claim 15 further comprising adjusting a weighting of said ball with at least one weighted member.

18. The process of claim 17 wherein the weighting of said ball is between 0.34 kilograms and 0.48 kilograms.

19. A method for playing a pin based game using a ball of claim 1 comprising:

situating a plurality of game pins on an elevated game board having a surface and at least one of sharp edges or sharp corners formed thereon;

throwing the ball to undergo substantial impacts with the plurality of game pins, the elevated game board, or a combination thereof, said shell and said skin protecting said inflatable bladder after at least 50 repeated impacts with the plurality of game pins, the elevated game board, or a combination thereof at an impact force of at least 100 times the force of gravity; and felling at least one of the plurality of game pins with the ball.

20. The method of claim 19 wherein the impact force is between 500 and 1500 times the force of gravity.

* * * * *